US006354254B1

(12) United States Patent
Usko

(10) Patent No.: US 6,354,254 B1
(45) Date of Patent: Mar. 12, 2002

(54) EXHAUST AND INTAKE ROCKER ARM ASSEMBLIES FOR MODIFYING VALVE LIFT AND TIMING DURING POSITIVE POWER

(75) Inventor: James N. Usko, North Granby, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/549,028

(22) Filed: Apr. 13, 2000

Related U.S. Application Data

(60) Provisional application No. 60/129,253, filed on Apr. 14, 1999.

(51) Int. Cl.[7] ..... F01L 13/06; F02D 13/04; F02M 25/07

(52) U.S. Cl. ..... 123/90.16; 123/90.39; 123/321; 123/568.14

(58) Field of Search ..... 123/90.15, 90.16, 123/90.17, 90.18, 90.22, 90.39, 90.4, 90.41, 90.44, 198 F, 320, 321, 322, 323, 568.14

(56) References Cited

U.S. PATENT DOCUMENTS

| | | | | | |
|---|---|---|---|---|---|
| 3,911,873 | A | | 10/1975 | Dave | 123/90.15 |
| 4,009,695 | A | | 3/1977 | Ule | 123/90.13 |
| 5,273,006 | A | * | 12/1993 | Schapertons et al. | 123/90.16 |
| 5,537,976 | A | | 7/1996 | Hu | 123/322 |
| 5,609,133 | A | * | 3/1997 | Hakansson | 123/321 |
| 5,619,965 | A | | 4/1997 | Cosma et al. | 123/322 |
| 5,626,116 | A | | 5/1997 | Reedy et al. | 123/321 |
| 5,679,094 | A | | 10/1997 | Nakamura et al. | 477/111 |
| 5,680,841 | A | * | 10/1997 | Hu | 123/322 |
| 5,809,952 | A | | 9/1998 | Ono et al. | 123/90.16 |
| 5,829,397 | A | * | 11/1998 | Vorih et al. | 123/90.12 |
| 5,890,469 | A | * | 4/1999 | H.ang.kansson et al. | 123/321 |
| 5,975,251 | A | * | 11/1999 | McCarthy | 188/31 |
| 6,058,895 | A | * | 5/2000 | Hermsen | 123/90.16 |
| 6,152,104 | A | * | 11/2000 | Vorih et al. | 123/322 |
| 6,220,212 | B1 | * | 4/2001 | Wakeman | 123/90.16 |

* cited by examiner

*Primary Examiner*—Weilun Lo
(74) *Attorney, Agent, or Firm*—David R. Yohannan; Mark W. Rygiel; Collier Shannon Scott, PLLC

(57) ABSTRACT

The present invention is directed to an apparatus for operating at least one intake valve and at least one exhaust valve in an engine cylinder. The apparatus includes an exhaust valve operating assembly for operating the at least one exhaust valve of the engine cylinder, wherein the exhaust valve operating assembly is capable of producing an exhaust gas recirculation event. The apparatus also includes an intake valve operating assembly for operating the at least one intake valve of the engine cylinder. The apparatus further includes an exhaust modifying assembly for modifying the operation of the exhaust valve operating assembly during a predetermined engine operating condition and an intake modifying assembly for modifying the operation of the intake valve operating assembly during a predetermined engine operating condition.

16 Claims, 9 Drawing Sheets

EXHAUST AND INTAKE ROCKER ARM ASSEMBLIES FOR MODIFYING VALVE LIFT AND TIMING DURING POSITIVE POWER

CROSS REFERENCE TO RELATED PATENT APPLICATION

This application relates to and claims priority on provisional application serial No. 60/129,253, filed Apr. 14, 1999.

FIELD OF THE INVENTION

The present invention relates generally to the control of exhaust and intake valves during positive power and engine braking. In particular, the present invention is directed to an assembly to modify the valve lift and timing of the exhaust valve and/or intake valve during positive power and different operating conditions during positive power.

BACKGROUND OF THE INVENTION

It has been published that an exhaust event with an internal hot exhaust gas recirculation ("EGR") event is beneficial in controlling emissions by directing a small amount of the exhaust gas back into the valve cylinder to mix with intake air. The combined intake and exhaust gas with the depleted oxygen helps create a lower burn temperature, which helps reduce the generation of nitrogen oxides. There are, however, certain positive power conditions during which the EGR event does not add any benefit. These conditions include a light load and low engine rpm. The EGR event also does not provide any benefit during engine braking where the EGR event reduces braking power. Therefore, it is desirable to have the EGR event to be selectable, on as desired during positive power and off during braking.

OBJECTS OF THE INVENTION

It is an object of the present invention to provide a device for an engine that can change the intake valve lift of an intake valve.

It is another object of the present invention to provide a device for an engine that can change the timing of the intake valve.

It is another object of the present invention to provide a device for an engine that can change the timing of the intake valve to improve emission and fuel economy.

It is another object of the present invention to provide a device for an engine that can advance or retard the timing of the intake valve to improve emission and fuel economy.

It is another object of the present invention to provide a device for an overhead cam diesel engine that can change the intake valve lift of the intake valve.

It is another object of the present invention to provide a device for an overhead cam diesel engine that can change the timing of the intake valve.

It is an object of the present invention to provide a device for an engine that can change the exhaust valve lift of an exhaust valve.

It is another object of the present invention to provide a device for an engine that can change the timing of the exhaust valve.

It is another object of the present invention to provide a device for an engine that can change the timing of the exhaust valve to improve emission and fuel economy.

It is another object of the present invention to provide a device for an engine that can advance or retard the timing of the exhaust valve to improve emission and fuel economy.

It is another object of the present invention to provide a device for an overhead cam diesel engine that can change the exhaust valve lift of the exhaust valve.

It is another object of the present invention to provide a device for an overhead cam diesel engine that can change the timing of the exhaust valve.

It is another object of the present invention to provide a device for an engine that permits the exhaust valve to operate with an EGR event when desired.

It is another object of the present invention to provide a device for an engine that permits an EGR event during selected operating conditions during positive power.

It is another object of the present invention to provide a device for an engine that does not permit an EGR event during engine braking.

SUMMARY OF THE INVENTION

The present invention is directed to an apparatus for operating at least one intake valve and at least one exhaust valve in an engine cylinder. The apparatus according to an embodiment of the present invention includes an exhaust valve operating assembly for operating the at least one exhaust valve of the engine cylinder, wherein the exhaust valve operating assembly is capable of producing an exhaust gas recirculation event. The apparatus further includes an intake valve operating assembly for operating the at least one intake valve of the engine cylinder, and exhaust modifying assembly for modifying the operation of the exhaust valve operating assembly during a predetermined engine operating condition.

In accordance with the present invention, the exhaust modifying assembly modifies the timing of the at least one exhaust valve during the predetermined engine operating condition. The predetermined engine operating condition is at least one of a first positive power operating condition, a second positive power operating condition and an engine braking condition.

In accordance with the present invention, the exhaust modifying assembly also modifies the lift of the at least one exhaust valve during the predetermined engine operating condition. The predetermined engine operating condition is at least one of a first positive power operating condition, a second positive power operating condition and an engine braking condition.

The exhaust valve operating assembly may include an exhaust rocker arm assembly pivotably mounted on a rocker shaft. The exhaust modifying assembly may include a hydraulic assembly in communication with the rocker shaft for controlling the operation of the at least one exhaust valve. The exhaust modifying assembly may further include a lash adjuster assembly on the exhaust rocker arm. The exhaust modifying assembly may further include a releasable assembly for releasably engaging a slot within the rocker shaft during the predetermined engine operating condition, wherein the releasable assembly controls the rotation of the exhaust rocker arm to modify at least one of the lift and timing of the at least one exhaust valve. The releasable assembly inhibits the operation of the lash adjuster assembly when the releasable assembly is located within the slot. Furthermore, the releasable assembly inhibits the exhaust gas recirculation event when the releasable assembly is received within the slot.

The apparatus according to another embodiment of thee present invention includes an exhaust valve operating assembly for operating the at least one exhaust valve of the engine cylinder, an intake valve operating assembly for operating the at least one intake valve of thee engine cylinder, and an intake modifying assembly for modifying the operation of the intake valve operating assembly during a predetermined engine operating condition.

In accordance with the present invention, the intake modifying assembly may modify the timing of the at least one intake valve during the predetermined engine operating condition. The predetermined engine operating condition is at least one of a first positive power operating condition, a second positive power operating condition and an engine braking condition.

In accordance with the present invention, the intake modifying assembly may further modify the lift of the at least one intake valve during the predetermined engine operating condition. The predetermined engine operating condition is at least one of a first positive power operating condition, a second positive power operating condition and an engine braking condition.

The intake valve operating assembly may include an intake rocker arm assembly pivotably mounted on a rocker shaft. The intake modifying assembly may include a hydraulic assembly in communication with the rocker shaft for controlling the operation of the at least one intake valve. The intake modifying assembly may further include a lash adjuster assembly on the intake rocker arm. The intake modifying assembly further includes a releasable assembly for releasably engaging a slot within the rocker shaft during the predetermined engine operating condition, wherein the releasable assembly controls the rotation of the intake rocker arm to modify at least one of the lift and timing of the at least one intake valve. The releasable assembly inhibits the operation of the lash adjuster assembly when the releasable assembly is located within the slot.

The present invention also is directed to an apparatus for operating at least one intake valve and at least one exhaust valve in an engine cylinder. The apparatus may include an exhaust valve operating assembly for operating the at least one exhaust valve of the engine cylinder, wherein the exhaust valve operating assembly is capable of producing an exhaust gas recirculation event. The apparatus also includes an intake valve operating assembly for operating the at least one intake valve of the engine cylinder. The apparatus may further include an exhaust modifying assembly for modifying the operation of the exhaust valve operating assembly during a predetermined engine operating condition and an intake modifying assembly for modifying the operation of the intake valve operating assembly during a predetermined engine operating condition.

The exhaust modifying assembly may modify the timing and lift of the at least one exhaust valve during the predetermined engine operating condition. The predetermined engine operating condition is at least one of a first positive power operating condition, a second positive power operating condition and an engine braking condition.

The intake modifying assembly may modify the timing and lift of the at least one intake valve during the predetermined engine operating condition. The predetermined engine operating condition is at least one of a first positive power operating condition, a second positive power operating condition and an engine braking condition.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE INVENTION

Figure 2:
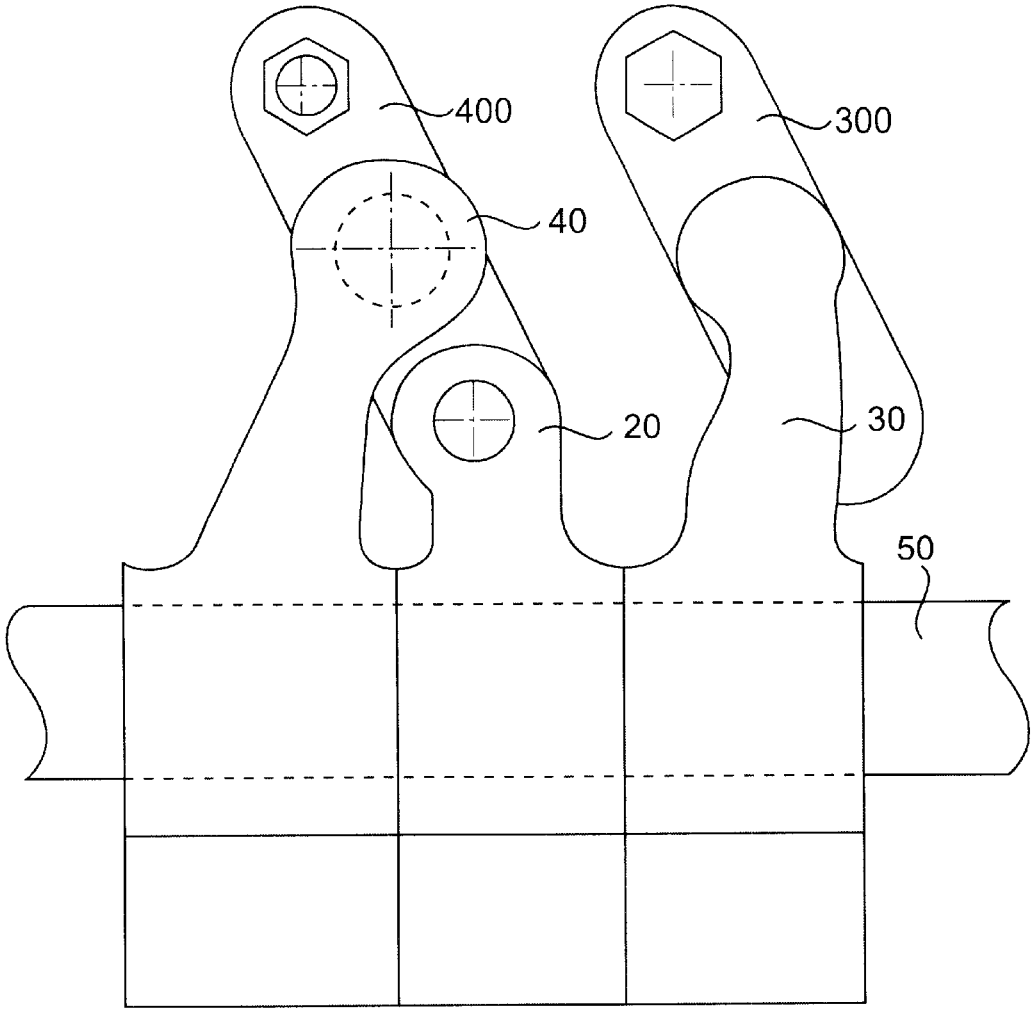
FIG. 2 is a top view of the arrangement of the rocker arm assemblies and the intake and exhaust valve assemblies in accordance with the present invention.

Reference will now be made in detail to a preferred embodiment of the present invention, an example of which is illustrated in the accompanying drawings. FIG. 2 illustrates a top view of the present invention in an overhead cam diesel engine. An intake rocker arm 30, an exhaust rocker arm 40 and a braking rocker arm 20 are pivotably mounted on and spaced along a rocker shaft 50. The intake rocker arm 30 is adapted to engage an intake valve crosshead 300 for at least one intake valve to operate the at least one intake valve. The exhaust rocker arm 40 is adapted to engage an exhaust valve crosshead 400 for at least one exhaust valve to operate the at least one exhaust valve during predetermined operating conditions. The braking rocker arm 20 is also adapted to engage the crosshead 400 to operate the at least one exhaust valve during an engine braking operation.

The rocker arms 20, 30 and 40 are spaced along a common rocker shaft 50 having at least two passages formed therein. The rocker shaft 50 has a passage 51 through which a supply of controlled engine oil or other suitable hydraulic fluid flows therethrough to exhaust rocker arm 40 on demand. A valve assembly 510 controls the flow of engine oil to the exhaust rocker arm 40. The valve assembly 510 is preferably a solenoid valve. It, however, is contemplated by the inventors of the present invention that other suitable valves may be substituted and are considered to be within the scope of the present invention. The valve assembly 510 may be located on one of the rocker shaft 50, the engine or the exhaust rocker arm 40.

The rocker shaft 50 has a passage 52 through which a supply of controlled engine oil or other suitable hydraulic fluid flows therethrough to the intake rocker arm 30. A valve assembly 520 controls the flow of engine oil to the intake rocker arm 30. The valve assembly 520 is preferably a solenoid valve. It, however, is contemplated by the inventors of the present invention that other suitable valves may be substituted and are considered to be within the scope of the present invention. The valve assembly 520 may be located on one of the rocker shaft 50, the engine or the intake rocker arm 30.

The rocker shaft 50 has a passage 53 through which a supply of controlled engine oil or other suitable hydraulic fluid flows therethrough to braking rocker arm 20 on demand. A valve assembly 530 controls the flow of engine oil to the braking rocker arm 20. The valve assembly 530 is preferably a solenoid valve. It, however, is contemplated by the inventors of the present invention that other suitable valves may be substituted and are considered to be within the scope of the present invention. The valve assembly 530 may be located on one of the rocker shaft 50, the engine or the braking rocker arm 20.

The rocker shaft 50 has a passage 54 through which a supply of engine oil or other suitable hydraulic fluid flows therethrough to lubricate the rocker arms 20, 30 and 40 to enable smooth pivotable movement of the rocker arms 20, 30 and 40 about common rocker shaft 50.

The rocker arms 20, 30 and 40 correspond to a cam shaft 10 having three spaced cam lobes 12, 13, and 14. Exhaust cam lobe 14 corresponds to the exhaust rocker arm 40. An EGR bump 11 also corresponds to the exhaust rocker arm 40. Intake cam lobe 13 corresponds to an intake rocker arm 30. Brake cam lobe 12 corresponds to a brake rocker arm 20.

Figure 3:
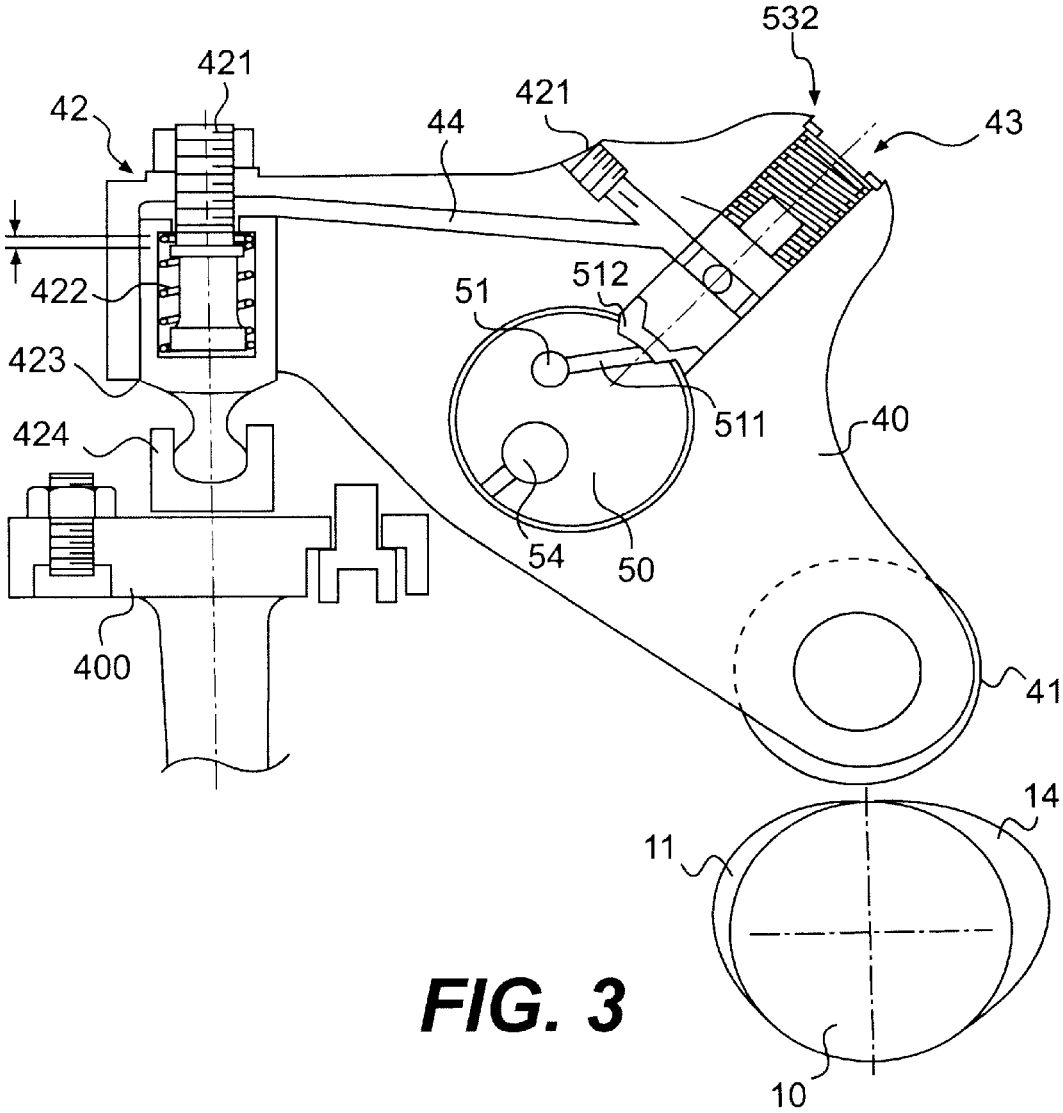
FIG. 3 is a schematic view of the exhaust rocker arm in accordance with the present invention.

The exhaust rocker arm 40, as shown in FIG. 3, is rotatably mounted on the common rocker shaft 50. A first end of the exhaust rocker arm 40 includes an exhaust cam lobe follower 41. The exhaust cam lobe follower 41 preferably includes a roller follower that is adapted to contact the exhaust cam lobe 14 and the EGR bump 11. A second end of the exhaust rocker arm 40 has a lash adjuster 42. The lash adjuster 42 is adjacent to a crosshead 400. The lash adjuster 42 is described in detail below. The crosshead 400 is preferably a bridge device that is capable of opening two exhaust valves simultaneously. The exhaust rocker arm 40 also includes a control valve 43. The control valve 43 is in communication with a fluid passageway 44 that extends through the exhaust rocker arm 40 to the lash adjuster 42. The control valve 43 is also in communication with a fluid passageway 511 in common rocker shaft 50 that extends between the control valve 43 and supply passage 51 of the common rocker shaft 50. The fluid passageway 511 terminates at a control slot 512. The control valve 43 is capable of being received within the control slot 512.

As discussed above, the lash adjuster 42 is located on one end of the exhaust rocker arm 40. The lash adjuster 42 includes a screw assembly 421 that permits manual adjustment of the lash. A desired lash may be set by rotating the screw assembly 421. A spring assembly 422 surrounds the screw assembly 421, as shown in FIG. 3. One end of the spring assembly 422 contacts an end of the screw assembly 421. An opposite end contacts a lash piston assembly 423, as shown in FIG. 3. A portion of the screw assembly 421 and the spring assembly 422 are received within a cavity within the piston assembly 423. A free end of the piston assembly 423 includes a pin 424 for contacting the crosshead 400. When the passageway 44 is filled with hydraulic fluid, hydraulic fluid then fills the cavity in the piston assembly 423. The piston assembly 423 moves downward against the bias of the spring assembly 422 such that the pin 424 contacts the crosshead 400. It, however, is contemplated by the inventor of the present invention that other suitable lash adjusters including, but not limited to, electronically operated lash adjusters and mechanically operated adjusters may be substituted for the above described hydraulic lash adjuster. These variations and modifications are considered to be within the scope of the present invention.

Figure 8:
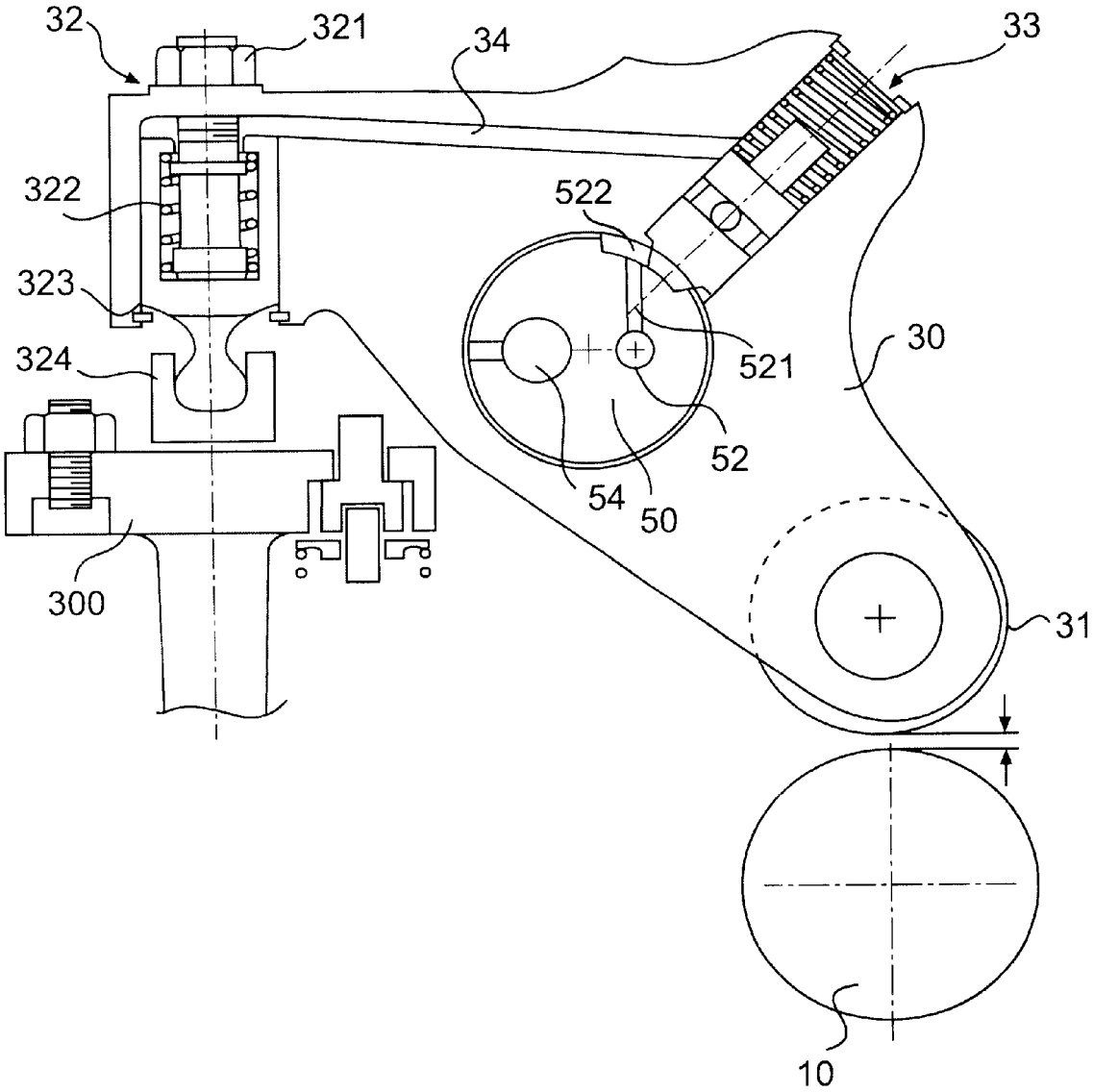
FIG. 8 is a schematic view of the intake rocker arm in accordance with the present invention.
Figure 9:
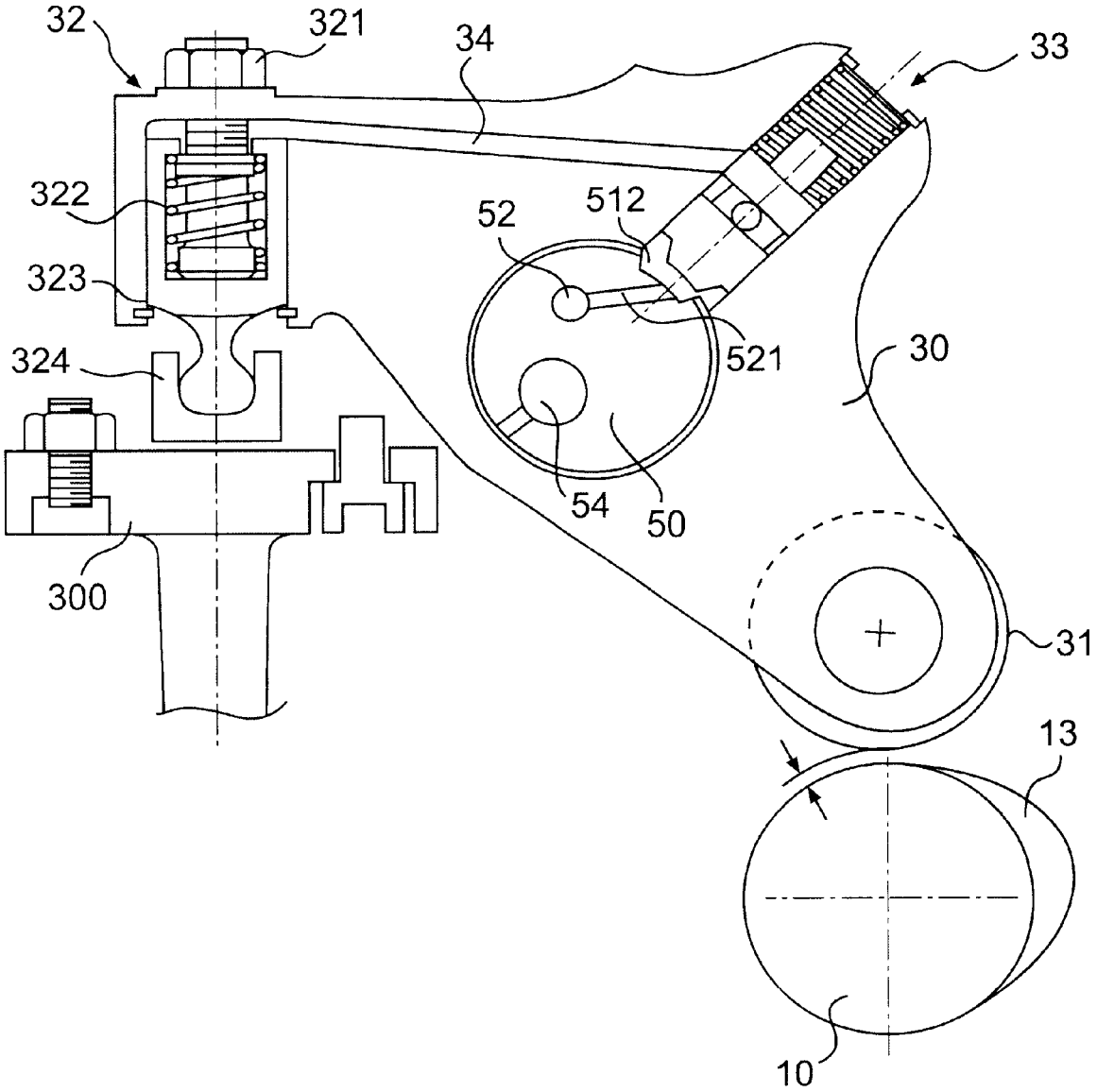
FIG. 9 is another schematic view of the intake rocker arm in accordance with the present invention.

The intake rocker arm 30, as shown in FIGS. 8 and 9, is rotatably mounted on the common rocker shaft 50. A first end of the intake rocker arm 30 includes an intake cam lobe follower 31. The intake cam lobe follower 31 is adapted to contact the intake cam lobe 13. A second end of the intake rocker arm 30 has a lash adjuster 32. The lash adjuster 32 has the same design as the lash adjuster 41 described above in connection with the exhaust rocker arm 40. The lash adjuster 32 is adjacent to a crosshead 300. The lash adjuster 32 is described in detail below. The crosshead 300 is also preferably a bridge device that is capable of opening two intake valves simultaneously. The intake rocker arm 30 also includes a control valve 33. The control valve 33 is in communication with a fluid passageway 34 that extends through the intake rocker arm 30 to the lash adjuster 32. The control valve 33 has the same construction as the control valve 43 described above in connection with the exhaust rocker arm 40. The control valve 33 is also in communication with a fluid passageway 521 that extends between the control valve 33 and supply passage 52 of the common rocker shaft 50. The fluid passageway 521 terminates at a control slot 522. The control slot 522 is not shown in the embodiment of FIG. 9. The control valve 33 is capable of being received within the control slot 522.

The lash adjuster 32 has a similar construction to the lash adjuster 42, discussed above. The lash adjuster 32 includes a screw assembly 321 that permits manual adjustment of the lash. A screw assembly 322 surrounds the screw assembly 321. One end of the screw assembly 322 contacts an end of the screw assembly 321. An opposite end contacts a lash piston assembly 323. A portion of the screw assembly 321 and the spring assembly 322 are received within a cavity within the piston assembly 323. A free of the piston assembly 323 includes a pin 324 for contacting the crosshead 300. When the passageway 34 is filled with hydraulic fluid hydraulic fluid then fills the cavity in the piston assembly 323. The piston assembly 323 moves downward against the bias of the spring assembly 322 such that the pin 324 contacts the crosshead 300. It, however, is contemplated by the inventor of the present invention that other suitable lash adjusters including, but not limited to, electronically operated lash adjusters and mechanically operated adjusters may be substituted for the above described hydraulic lash adjuster. These variations and modifications are considered to be within the scope of the present invention.

Figure 10:
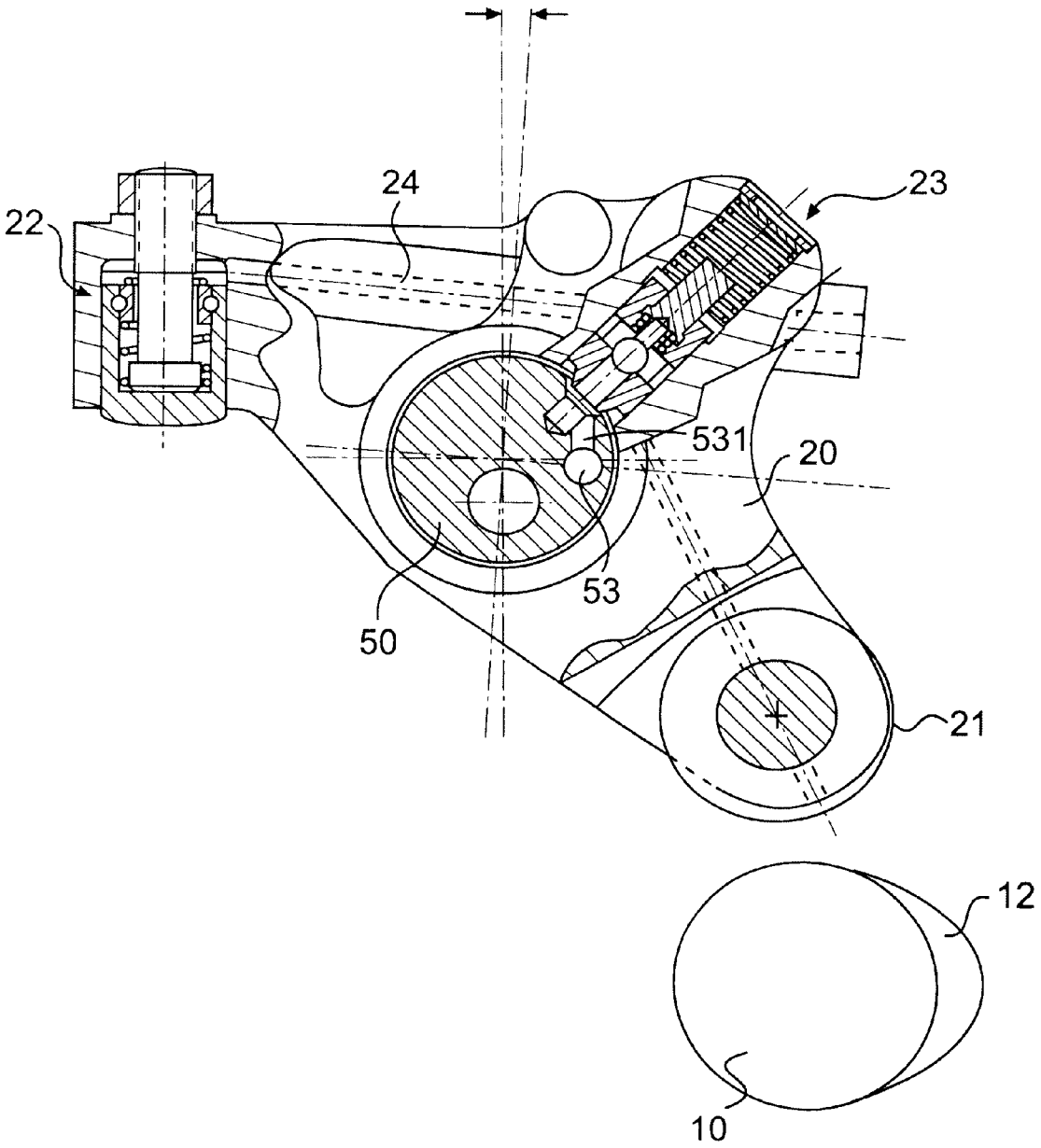
FIG. 10 is a schematic view of the braking rocker arm in accordance with the present invention.

The braking rocker arm 20, as shown in FIG. 10, is rotatably mounted on the common rocker shaft 50. The structure of the braking rocker arm 20 is similar to that disclosed in U.S. patent application Ser. No. 09/165,291, entitled "Improved Rocker Brake Assembly With Hydraulic Lock," the disclosure of which is incorporated herein by reference. A first end of the brake rocker arm 20 includes a brake cam lobe follower 21. The brake cam lobe follower 21 preferably includes a roller follower that is in contact with the brake cam lobe 12. A second end of the brake rocker arm 20 has an actuator piston 22. The actuator piston 22 is spaced from the crosshead 400 of thee exhaust rocker arm 40. When activated, the brake rocker arm 20 and the actuator piston 22 contact the crosshead 400 to open the at least one exhaust valve. The brake rocker arm 20 also includes a control valve 23. The valve 23 is in communication with a fluid passageway 24 that extends through the braking rocker arm 20 to the actuator piston 22. The valve 24 is also in communication with a fluid passageway 531 that extends between the valve 24 and passage 53 of the common rocker shaft 50.

OPERATION DURING POSITIVE POWER

In accordance with the present invention, there are at least two engine operating conditions during the positive power engine operating mode. The first operating condition during positive power occurs during light loads and low engine rpm, essentially when an EGR event does not provide any benefit. The second operating condition during positive power occurs when an EGR event is beneficial.

Figure 1:
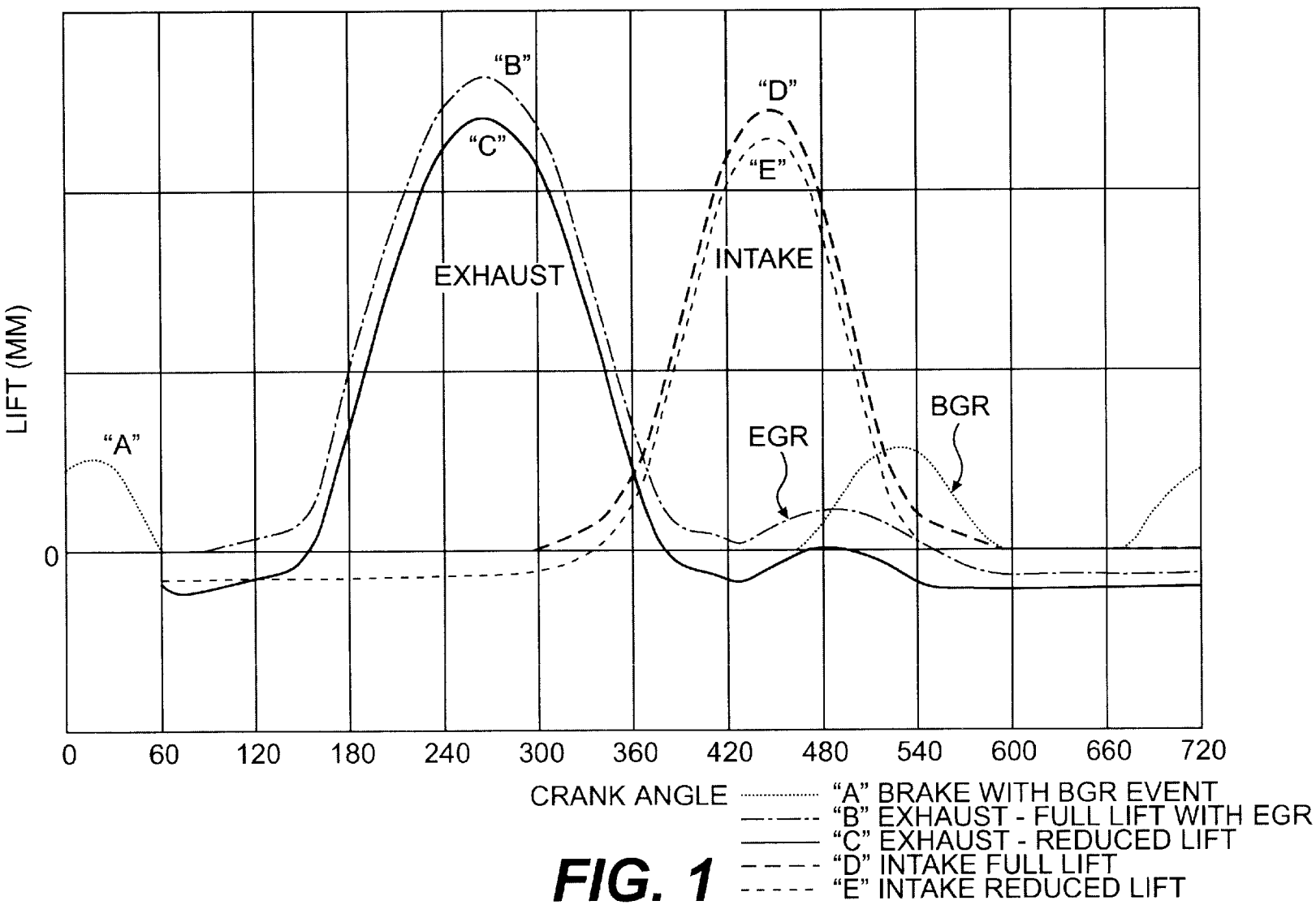
FIG. 1 is a graph depicting exhaust and intake valve lift during various engine operating conditions during positive power and engine brakings.
Figure 4:
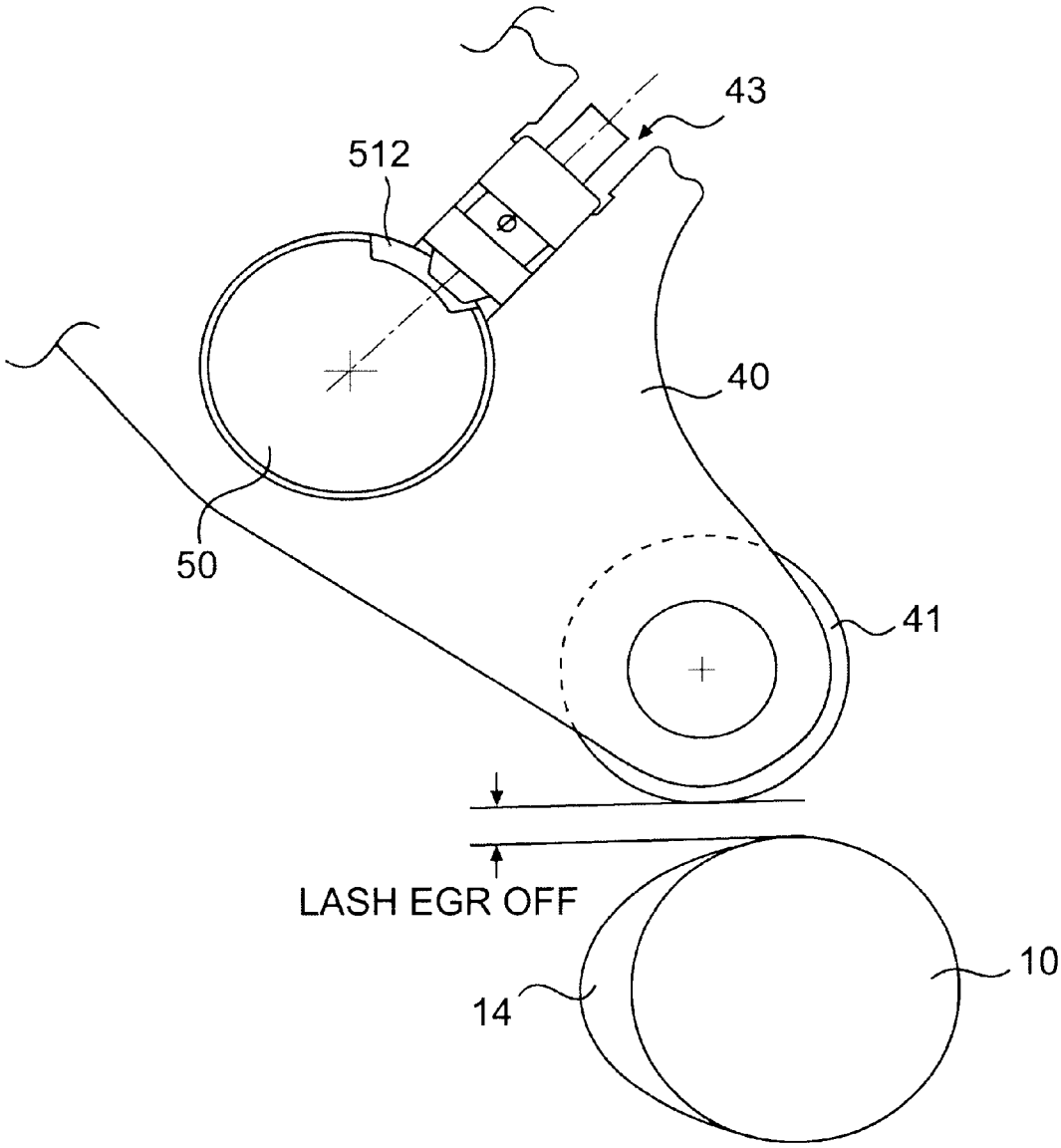
FIG. 4 is a partial schematic view of the exhaust rocker arm of FIG. 3 with control valve in a position to preclude an EGR event.
Figure 5:
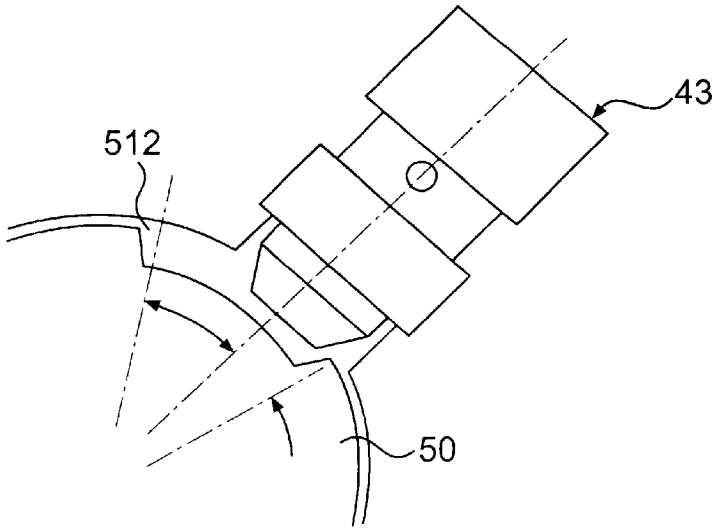
FIG. 5 is a partial exploded view of the exhaust rocker arm of FIG. 3 depicting the control valve positioned within a slot in the common rocker shaft during engine braking and a first positive power operating condition.

The operation of thee exhaust rocker arm 40 during the first operating condition during positive power will now be described. During the first operating condition, the valve assembly 510 is closed. Hydraulic fluid does not flow from the passage 51 to the exhaust rocker arm 40. The control valve 43 remains within the control slot 512, as shown in FIGS. 4 and 5. The range of movement of thee rocker arm 40 is limited to the size of the control slot 512. Hydraulic fluid is not provided to the lash adjuster 42. The lash adjuster 42 does not extend which reduces exhaust valve lift and delays exhaust valve timing, as shown in FIG. 1 by line C. Furthermore, the lift associated with the EGR bump 11 is absorbed so no EGR event is produced.

The operation of the intake rocker arm 30 during the first operating condition during positive power will now be described. During the first operating condition, the valve assembly 520 is closed. Hydraulic fluid does not flow from the passage 52 to the intake rocker arm 30. The control valve 33 remains within the control slot 522, as shown in FIG. 8. The range of movement of the rocker arm 30 is limited to the size of the control slot 522. Hydraulic fluid is not provided to the lash adjuster 32. The lash adjuster 32 does not extend which reduces intake valve lift and delays intake valve timing, as shown in FIG. 1 by line E.

The operation of thee braking rocker arm 20 during the first operating condition during positive power will now be described. During the first operating condition, the valve assembly 530 is closed. The control valve 23 remains seated within the recess 532 of the rocker shaft 50. The braking rocker arm 20 is disabled. The brake cam lobe follower 21 does not contact the braking lobe 12.

Figure 6:
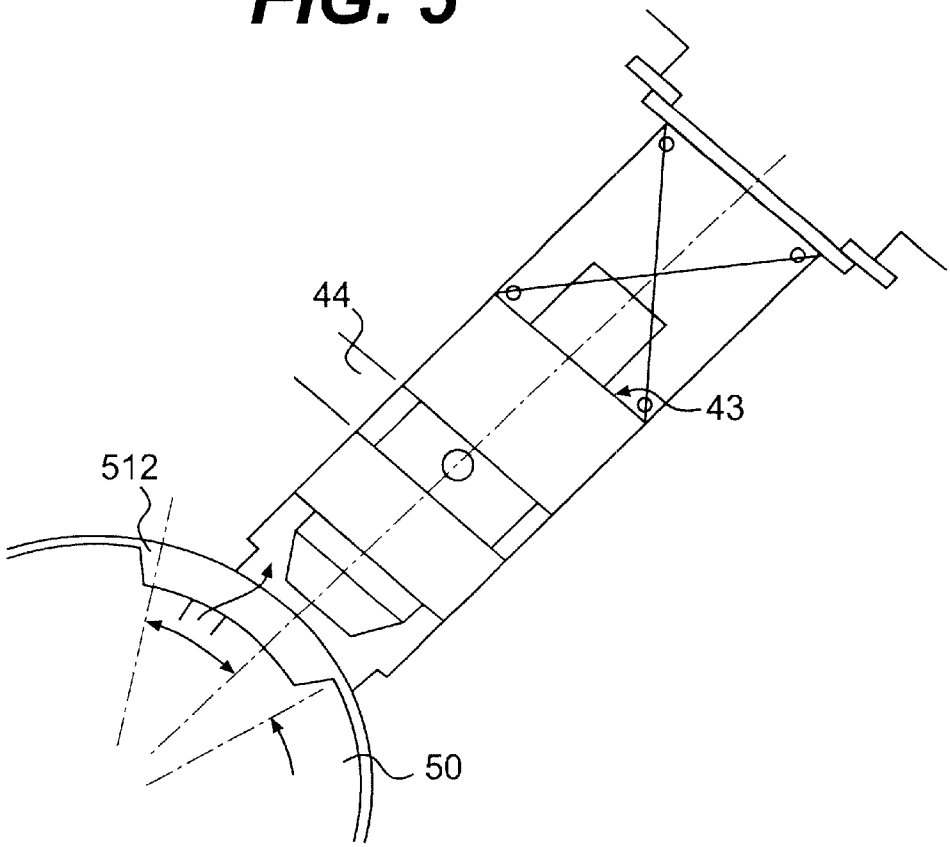
FIG. 6 is a partial exploded view of the exhaust rocker arm of FIG. 3 depicting the control valve positioned outside the slot in the common rocker shaft during a second positive power operating condition.
Figure 7:
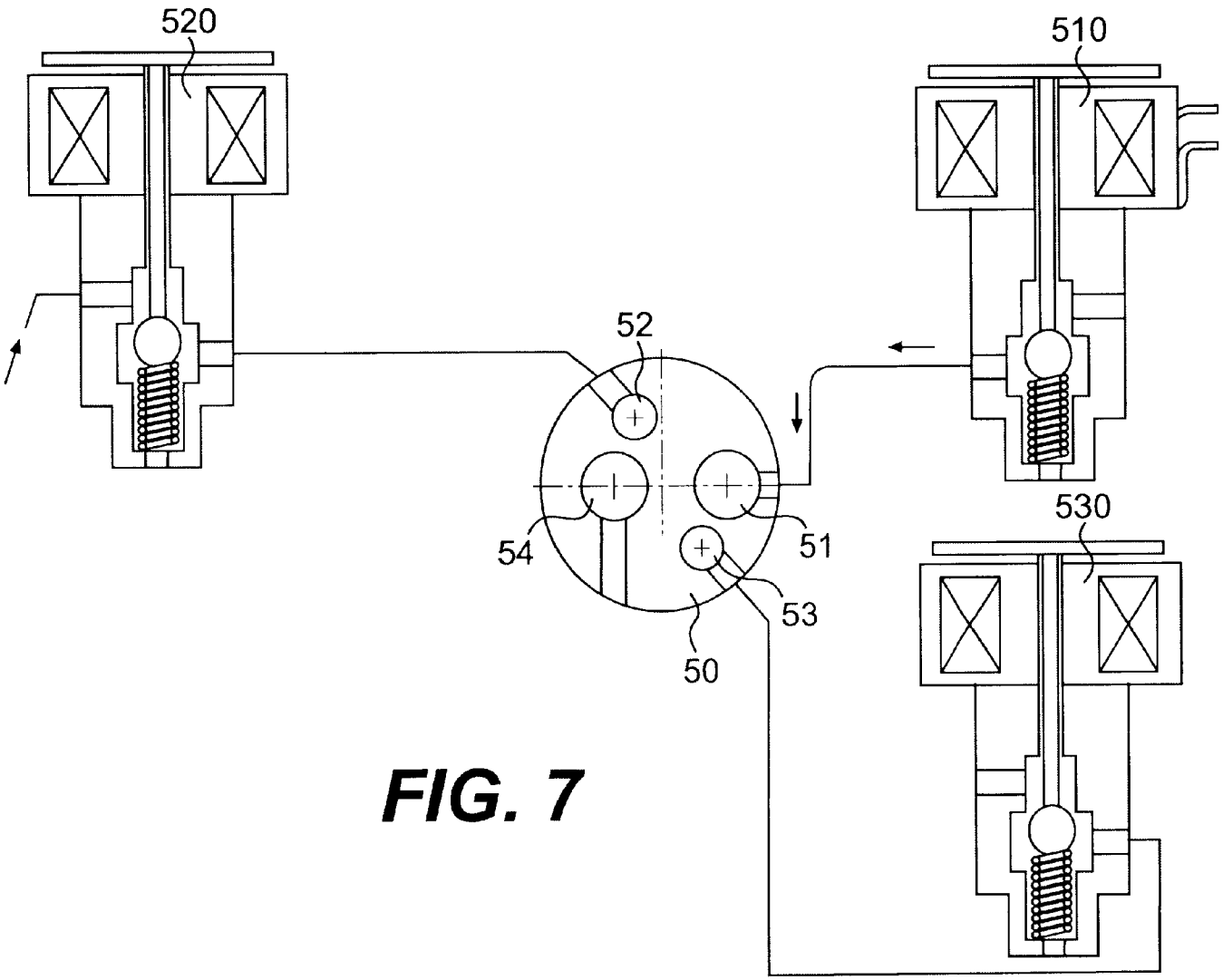
FIG. 7 is a schematic view depicting the exhaust, intake and braking valve assemblies in connection with the common rocker shaft.

The operation of the exhaust rocker arm 40 during the second operating condition during positive power will now be described. During the second operating condition, the valve assembly 510 is open. Hydraulic fluid flows from the passage 51 in the common rocker shaft 50. The presence of hydraulic fluid within fluid passageway 511 and control slot 512 causes the control valve 43 to be biased out of the control slot 512, as shown in FIGS. 3 and 6. The range of movement of the rocker arm 40 is not limited. Furthermore, hydraulic fluid is provided to the lash adjuster 42, which extends to contact crosshead 400. All movement of the rocker arm 40 when contacting exhaust cam lobe 14 is transferred to the crosshead 400 through the lash adjuster 42. As such, there is no reduction in exhaust valve lift, as shown by line B in FIG. 1. Furthermore, there is no delay in exhaust valve timing, as shown in FIG. 1 by line B.

The operation of the intake rocker arm 30 during the second operating condition during positive power will now be described. During the second operating condition, the valve assembly 520 is open. Hydraulic fluid flows from the passage 52 in the common rocker shaft 50. The presence of hydraulic fluid within fluid passageway 521 and control slot 522 causes the control valve 33 to be biased out of the control slot 522. The range of movement of the intake rocker arm 30 is not limited. Hydraulic fluid is permitted to flow to lash adjuster 432, which extends to contact crosshead 300. All movement of the intake rocker arm 30 when contacting intake cam lobe 13 is transferred to the crosshead 300 through the lash adjuster 32. As a result, there is no reduction in intake valve lift and no delay in intake valve timing, as shown in FIG. 1 by line D.

The operation of the braking rocker arm 20 during the second operating condition during positive power is the same as during the first operating condition. The braking rocker arm 20 is disabled.

It is contemplated by the inventor of the present invention that the valve assemblies 510 and 520 may be independently operated and adjusted to independently vary the timing and lift of the exhaust valves and the intake valves.

OPERATION DURING ENGINE BRAKING

The operation of the exhaust rocker arm 40 will now be described during an engine braking operation. During engine braking, the valve assembly 510 is closed. This permits the hydraulic fluid within the passageway 44 to drain from the rocker arm 40, which causes the lash adjuster 42 to retract such that it is not in contact with crosshead 400. Hydraulic fluid does not flow from the passage 51 to the exhaust rocker arm 40. The control valve 43 returns to a position within the control slot 512, as shown in FIGS. 3 and 6. The range of movement of the rocker arm 40 is then limited to the size of the control slot 512. The lash adjuster 42 again reduces exhaust valve lift and delays exhaust valve timing, as shown in FIG. 1 by line C. Furthermore, the lift associated with the EGR bump 11 is absorbed so no EGR event is produced. The operation of the intake rocker arm 30 during the engine braking will now be described. The valve assembly 520 is closed. This permits the hydraulic fluid within the passageway 34 to drain from the intake rocker arm 30, which causes the lash adjuster 32 to retract such that it is not in contact with crosshead 300. Hydraulic fluid does not flow from the passage 52 to the intake rocker arm 30. The control valve 33 returns to a position within the control slot 522, as shown in FIG. 8. The range of movement of the rocker arm 30 is again limited to the size of the control slot 522. The lash adjuster 32 does not extend which reduces intake valve lift and delays intake valve timing, as shown in FIG. 1 by line E.

The operation of the braking rocker arm 20 during an engine braking operation will now be described. During engine braking, the valve assembly 530 is operated. Hydraulic fluid is permitted to flow from passage 53 through passageway 531 within the rocker shaft 50. The control valve 23 is biased against the flow of hydraulic fluid such that hydraulic fluid flows through passageway 24 to the actuator piston 22. The actuator piston 22 then extends to a fully extended position such that it contacts crosshead 400. When the passageway 24 is filled with hydraulic fluid and the pressure is equalized within valve 23, a hydraulic lock is formed thus holding the actuator piston 22 in an extended position. The operation of the exhaust valve is now partially controlled by the braking rocker arm 20 in response to actuation by the brake cam lobe 12. The operation of the exhaust valves will occur in response to the profile of the brake cam lobe 12, as shown in FIG. 1 by line A.

It will be apparent to those skilled in the arts that various modifications and variations can be made in the construction and configuration of the present invention, without departing from the scope or spirit of the invention. For example, the braking rocker arm 20 may be eliminated. Engine braking can occur using conventional methods. Several variations have been discussed in the preceding text. Furthermore, it is contemplated that the present invention may be used with a common rail camless type engine whereby the above described rocker arms may be electronically operated. Others will be apparent to persons of ordinary skills in the art. It is intended that the present invention cover the modifications and variations of the invention, provided they come within the scope of the appended claims and their equivalence.

What is claimed is:

1. An apparatus for operating at least one engine valve in an engine cylinder, said apparatus comprising:

a rocker arm pivotally mounted on a rocker shaft for operation the at least one engine valve;

a valve train assembly in selective contact with said rocker arm for rotating said rocker arm through a rotation range about the rocker shaft;

means for controlling the range of rocker arm rotation during a predetermined engine operating condition; and wherein said valve train assembly is a cam.

2. The apparatus according to claim 1, wherein said control means comprises:

a control slot formed in the rocker shaft; and a releasable assembly housed in a bore formed in said rocker arm for selectively releasably engaging said control slot.

3. The apparatus according to claim 2, wherein said control means modifies the timing of the opening of the at least one engine valve during the predetermined engine operating condition when said releasable assembly is received within said control slot.

4. The apparatus according to claim 3, wherein the predetermined engine operating condition is at least one of a first positive power operating condition, a second positive power operating condition and an engine braking condition.

5. The apparatus according to claim 2, wherein said control means modifies the lift of the at least one engine valve during the predetermined engine operating condition when said releasable assembly is received within said control slot.

6. The apparatus according to claim 5, wherein said predetermined engine operating condition is at least one of a first positive power operating condition, a second positive power operating condition and an engine braking condition.

7. The apparatus of claim 2, wherein said control means further comprises:

supply means for selectively supplying hydraulic fluid to said rocker arm; and a hydraulic circuit formed in said rocker arm for receiving the hydraulic fluid from said supply means and providing the hydraulic fluid to said releasable assembly.

8. The apparatus of claim 2, wherein said releasable assembly is a control valve.

9. The apparatus of claim 2, wherein the range of rocker arm rotation is limited by the size of said control slot.

10. The apparatus of claim 2, wherein said releasable assembly selectively limits the contact between said rocker arm and said valve train assembly.

11. The apparatus of claim 2, wherein said predetermined engine condition is a low RPM positive power engine operating condition, and wherein said releasable assembly modifies an exhaust gas recirculation event when said releasable assembly is received within said control slot.

12. The apparatus of claim 2, wherein said control means further comprises a lash adjuster housed in a bore formed in said rocker arm, wherein said releasable assembly modifies the operation of said lash adjuster assembly when said releasable assembly is located within said control slot.

13. The apparatus according to claim 1, wherein said at least one engine valve is at least one exhaust valve.

14. The apparatus according to claim 1, wherein said at least one engine valve is at least one intake valve.

15. A method got selectively modifying an engine valve event during a predetermined engine operating condition, said method comprising the steps of:

selectively supplying hydraulic fluid to a rocker arm pivotally mounted on a rocker shaft;

providing a valve train assembly in selective contact with said rocker arm for rotating said rocker arm through a rotation range about the rocker shaft, wherein said valve train assembly is a cam; and controlling a rotation range of the rocker arm on the rocker shaft responsive to the supply of the hydraulic fluid to the rocker arm to thereby modify the engine valve event.

16. The method of claim 15, wherein the engine valve event is an exhaust gas recirculation event and wherein the predetermined engine operating condition is at least one of a first positive power operating condition, a second positive power operating condition and an engine braking condition.

* * * * *

UNITED STATES PATENT AND TRADEMARK OFFICE

CERTIFICATE OF CORRECTION

PATENT NO. : 6,354,254 B1
DATED : March 12, 2002
INVENTOR(S) : James N. Usko

It is certified that error appears in the above-identified patent and that said Letters Patent is hereby corrected as shown below:

Column 9,
Line 23, replace "operation" with -- operating --.

Signed and Sealed this

Thirteenth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,354,254 B1
DATED : March 12, 2002
INVENTOR(S) : James N. Usko

It is certified that error appears in the above-identified patent and that said Letters Patent is hereby corrected as shown below:

Column 10,
Line 33, replace "got" with -- for --

Signed and Sealed this

Tenth Day of June, 2003

JAMES E. ROGAN
*Director of the United States Patent and Trademark Office*